US005112030A

United States Patent [19]

Tahara et al.

[11] Patent Number: 5,112,030

[45] Date of Patent: May 12, 1992

[54] HEAT TREAT FURNACE FOR FLUORINATING STEEL MATERIAL

[75] Inventors: Masaaki Tahara; Haruo Senbokuya; Kenzo Kitano, all of Osaka; Teruo Minato, Wakayama, all of Japan

[73] Assignees: Daidousanso Co., Ltd.; Maizuru Kogyo Co., Ltd., both of Osaka, Japan

[21] Appl. No.: 590,825

[22] Filed: Oct. 1, 1990

[51] Int. Cl.[5] ..... C21D 9/663

[52] U.S. Cl. ..... 266/256; 266/255; 266/252

[58] Field of Search ..... 266/256, 252, 255

[56] References Cited

U.S. PATENT DOCUMENTS

| | | | |
|---|---|---|---|
| 568,314 | 12/1958 | Knight | 266/256 |
| 3,024,015 | 3/1962 | Huebler et al. | 266/256 |
| 3,980,467 | 9/1976 | Camacho | 75/10 R |
| 4,846,675 | 7/1989 | Soliman | 432/23 |

FOREIGN PATENT DOCUMENTS

| | | |
|---|---|---|
| 0352061 | 1/1990 | European Pat. Off. . |
| 0152947 | 12/1981 | Fed. Rep. of Germany . |

*Primary Examiner*—Deborah Yee
*Attorney, Agent, or Firm*—Armstrong, Nikaido, Marmelstein, Kubovcik & Murray

[57] ABSTRACT

This invention relates to a method of nitriding steel material in a second heat treatment furnace after fluorinating the steel material in a first heat treat furnace to form a deep and uniform nitrided layer. Then, steel material is treated smoothly by defining the ratio of establishing said both furnaces for fluorinating and nitriding on the basis of treating time required for said both treatments since time required for each treatment is different.

2 Claims, 2 Drawing Sheets

HEAT TREAT FURNACE FOR FLUORINATING STEEL MATERIAL

TECHNICAL FIELD

This invention relates to a method of nitriding steel and heat treat furnaces used therein. According to the invention, when forming a nitrided layer on a steel surface, the nitrided layer can be formed deeply and uniformly by conducting special pre-treatment, and treated steel quantity per unit time can be increased.

PRIOR ART

The methods of nitriding steel articles or works for the formation of a nitrided layer on their surface have been employed for the purpose of improving mechanical properties such as wear resistance, corrosion resistance and fatigue strength, among others. As representative methods of nitriding steel among these there are nitriding methods, such as gas nitriding and gas soft, by a sole gas of ammonia or a mixed gas of ammonia and a gas containing carbon source (RX gas). However, these methods are disadvantageous in stability of treatment that uneven nitriding may easily occur when alloy steel or works of which the shape is complicated are treated.

Generally, steel material is nitrided at temperatures not lower than 500° C. For the adsorption and diffusion of nitrogen into the steel surface layer, it is required that the surface should be freed not only of organic and inorganic contaminants but also of an oxide layer. It is also necessary that the steel surface layer itself should be highly activated. In particular, however, it is impossible in nitriding mentioned above to prevent the oxide layer formation and to activate the steel surface layer completely. For example, in the typical case of cold-working austinitic stainless steel works, passive surface coat layers are removed by cleaning with a hydrofluoric acid-nitric acid mixture prior to charging the stainless steel into a treating furnace. It is difficult to remove them completely and to activate the steel surface layers completely, so that satisfactory nitrided layer formation is almost impossible. In order to remove organic and inorganic contaminants from the steel surface, degreasing with an alkaline cleaning solution or washing with an organic solvent such as trichloroethylene and the like are carried out. However, in view of the recent regulation against environmental pollution (regulations against destruction of the ozone layer), the use of organic solvents with highest cleaning effects should be avoided. Therefore, it is one of the reasons why a preferable nitrided layer can not be formed.

The inventors found out that when the steel works are fluorinated by holding in a heated condition in a fluorine-or fluoride-containing gas atmosphere prior to nitriding and then nitrided, cleaning (removal of organic or inorganic contaminants, oxide layer and the like) and activation of the steel surface can be realized to give a preferable nitrided layer. This has been filed under Japanese Patent Application No. 177660/1989 and U.S. Ser. No. 479,013. In this method, the steel articles are heated in a furnace to raise temperature thereof, and in that state, the heated steel articles are in contact with fluorine- or fluoride-containing gas such as $NF_3$ to pretreat. As a result, organic and inorganic contaminants adhered to the steel surface are destructed by activated fluorine atoms to remove the contaminants from the steel surface, and a passive coat layer such as an oxide layer of the steel surface is changed to a fluorinated layer to cover and protect the steel surface thereby, and then the works are nitrided. Said fluorinated layer is destructed and removed in nitriding by introducing a mixed gas of nitriding gas containing nitrogeneous source (e. g. $NH_3$ gas) and $H_2$ gas into the furnace in a heated condition.

Describing in detail, a cleaned and activated steel surface can be obtained by destruction and removal of said fluorinated layer, so that N atoms in the nitriding gas penetrate and diffuse inside the bare cleaned and activated steel rapidly to uniformly form a deep nitrided layer. Furthermore, the inventors developed a furnace apparatus with two chambers for nitriding and fluorinating for carrying out the above-mentioned basic invention and it has been filed under Japanese Patent Application No. 333425/1989 and U.S. Ser. No. 560,694. As a result of operational experiment with this apparatus, they found out that there was a big difference in time between fluorinating the steel with said fluorine- and fluoride-containing gas and nitriding it. Therefore, it is another problem that a series of processes from pretreating to nitriding of the steel can not be conducted continuously and effectively.

OBJECT OF THE INVENTION

Accordingly, it is an object to provide a method of nitriding steel and heat treatment furnaces used therein, wherein a series of processes from pretreating to nitriding of steel works can be carried out effectively and an uniform and deep nitrided layer can be obtained.

DISCLOSURE OF THE INVENTION

In order to accomplish the above-mentioned object, the present invention provides as a first gist a method of nitriding steel comprising steps of holding steel material in a first heat treat furnace in a heated state and in an atmosphere of fluorine- or fluoride-containing gas to fluorinate and then holding the fluorinated steel material in a second heat treat furnace in a heated state and in an atmosphere of nitriding gas, characterized in that integral times of the second heat treatment furnaces against the first heat treat furnace are disposed so as to treat the amount which is treated in the first heat treat furnace per unit time and the fluorinated steel material in the first heat treat furnace is introduced one after another into a plurality of the second heat treatment furnaces to nitride, as a second gist a heat treat furnace for fluorinating comprising a lifting type inner cover contained the steel material therein removably, a lifting type bell formed outer cover which covers the inner cover keeping a defined space from the inner cover, wherein the inside of the inner cover is formed as a fluorinating chamber, a feeding pipe of fluorine- or fluoride-containing gas and an exhaust pipe in said fluorinating chamber, the space between the inner cover and the outer cover is formed as a heating chamber, and a means for heating the fluorinating chamber is disposed in said heating chamber, and as a third gist a heat treat furnace for nitriding comprising an lifting type inner cover contained the fluorinated steel material therein removably, a lifting type bell formed outer cover which covers the inner cover keeping a defined space from the inner cover, wherein the inside of the inner cover is formed as a nitriding chamber, a feeding pipe of nitriding gas and an exhaust pipe are disposed in said nitriding chamber, the space between the inner cover and the outer cover is formed as a heating chamber, and a means for heating the nitriding chamber is disposed in said heating chamber.

In the method of nitriding steel according to the present invention, the steel works are pretreated specially using fluorine-or fluoride-containing gas prior to nitriding to be able to form a nitrided layer deeply and uniformly as well as in the above-mentioned basic invention. In addition, nitrided steel amount per unit time can be improved largely since the pretreatment and the nitriding are conducted not in a same furnace but in separate furnaces respectively. The establishment ratio of the two furnaces is decided rationally on the basis of treated steel amount per unit time in a fluorinating heat treat furnace and treated steel amount per unit time in a nitriding heat treat furnace.

In heat treat furnaces according to the present invention, since an inner cover and an outer cover thereof are capable of lifting up, the inside of the furnace is repaired easily and quickly by lifting them up, for example, when the inner surface of the inner cover, fan or the like are worn out by fluorine- or fluoride-containing gas, nitriding gas or the like. Their wear is also easily checked.

The invention is described in detail as follows.

In the present invention, surface of steel works is pretreated using fluorine- or fluoride containing gas.

The term "fluorine- or fluoride-containing gas" as used herein means a dilution of one or more fluorine source components selected from among $NF_3$, $BF_3$, $CF_4$, HF, $SF_6$ and $F_2$ in an inert gas such as $N_2$. The $NF_3$, $BF_3$, $CF_4$, and $F_2$ are gaseous and $SF_6$ is liquid at ambient temperature. These are mixed alone or together with an inert gas such as $N_2$ to compose fluorine- or fluoride-containing gas in the present invention. $NF_3$ is most suited for practical use since it is superior in safety, reactivity, controllability, handling and other properties among the above-mentioned fluorine source components. $F_2$ is not preferable since it has high reactivity and toxicity. It is disadvantageous in handling and in operation of the furnace. $BF_3$, $SF_6$ or like gas is effective in nitrided layer formation but not suitable generally in noxious reactant formation by B and S. Gas such as $FCl_3$ is not preferable in chloride formation such as $FeCl_3$ having high sublimation. Generally the fluorine- or fluoride-containing gas is used in a high temperature atmosphere. From the view point of effectiveness, concentration of the fluorine source component, such as $NF_3$, should amount to in a range of 0.05 to 20% (by weight, hereinafter same) in such fluorine- or fluoride-containing gas, preferably 2 to 7%, and more preferably 3 to 5%.

Among steels which may be treated by the invention, various species of steel material such as carbon steel and stainless steel are included. The shape of the material is not limited in particular. Any form of plate, coil, worked screw and others may be used. This invention includes, as its steel material, not only one material mentioned above, but also an alloy which is made of the above-mentioned materials mixed properly or an alloy which is mixed one of the above-mentioned materials as a main component with other metallic materials except the above-mentioned main component.

In this invention, said steel works are, for example, fluorinated as below-mentioned. That is, said steel works are charged into a first heated furnace for fluorination and heated to raise the temperature of the works in a range of 150° C. to 600° C., preferably 250° C. to 380° C. Then in that state, fluorine- or fluoride-containing gas such as $NF_3$ is fed to the heated furnace. The steel articles are held at the above-mentioned temperatures in a fluorine- or fluoride-containing gas (e.g. $NF_3$) atmosphere for 10 to 120 minutes, preferably 20 to 90 minutes, more preferably 30 to 60 minutes. As a result, a passive coat layer (comprising mainly an oxide layer) on the steel surface is changed to a fluorinated layer. This reaction is carried out on the basis of the below-mentioned formulas.

$$FeO + 2F \rightarrow FeF_2 + \tfrac{1}{2}O_2$$

$$Cr_2O_3 + 4F \rightarrow 2CrF_2 + 3/2O_2$$

The above-mentioned process is carried out using a heat treat furnace for fluorination having structure as shown in FIG. 1. In the drawing, the reference numeral 1 indicates a bell form outer cover, and 2 a cylindrical inner cover covered by said outer cover 1. A frame body 10 having a connecting part 10*a* is disposed integrally at the top of the outer cover 1 for hooking a hook of crane or the like. A lid body 11 having a connecting part 11*a* for hooking a hook of crane or the like is disposed integrally at the top of the inner cover 2. Inside of the inner cover 2 is formed as a fluorinating chamber and a space between both covers 1 and 2 is formed as a heating chamber. Reference numeral 3 is steel material which is charged removably in the inner cover 2. The steel material 3 is placed on a frame 15 having a center hole 14 and piled in a space between a first cylindrical net body 16 extending from the center hole 14 upwardly and a second cylindrical net body 17*a* extending from circumference of the frame 15 upwardly in a multi-stage state via porous dividing plates 17*b* having a center hole. A hole 4 for inserting a burner is made on a surrounding wall of the lower part of the outer cover 1 and a exhaust port 4*a* is made on a surrounding wall of the upper part of the outer cover 1. Reference numeral 5 indicates a base, 6 a fan for circulating air in the furnace. The fan 6 faces the center hole 14 of said frame 15 and the air in the furnace is circulated by the fan through the center hole 14 and the cylindrical net body 16. A heat exchanger 7 is disposed at a pipe 7*a* extending downwardly from a base of the inner cover 2. A circulating blower 8 for forced cooling is disposed at the pipe 7*a* as well as the heat exchanger 7. The reference numeral 9 indicates a pipe for introducing fluorine- or fluoride-containing gas such as $NF_3$ into the inner cover 2. An exhaust pipe 12*a* for taking out exhaust gas in the inner cover 2 is divided into two in the middle section. One of the separated pipes 17 has a valve 18, and another pipe 19 has a valve 20 and a vacuum pump 21. When the exhaust gas pressure in the inner cover 2 is high, the gas is led through the separated pipe 17, and when low, the gas is led through pipe 19 because the exhaust gas is evacuated by a suction force of the vacuum pump 21. A noxious substance eliminator 12 is connected with the end of said exhaust gas pipe 12*a*. The eliminator 12 comprises a couple of left and right activated charcoal cylinders 22, heater coil 23 around the cylinder 22, and a fin tube heat exchanger 24. The exhaust gas is introduced to the activated charcoal cylinders 22 and residual $NF_3$ in the exhaust gas and the like is heat reacted with activated charcoal to change to harmless $CF_4$. It is led to the fin tube exchanger 24 and cooled therein. A scrubber 13 is disposed with a pipe 25 extending from said heat exchanger 24. In the scrubber 13, water is filled and the exhaust gas from the pipe 25 is made in a bubble state to dissolve HF (a by-product of reaction of $NF_3$ with $H_2O$ and $H_2$ in the inner cover 2) contained in the exhaust gas in water. Thereby the exhaust gas becomes completely harmless and is released to the air.

In the heat treat furnace, the outer cover 1 and the inner cover 2 are lifted up by a crane (not shown) or the like by hooking hooks thereof to the connecting portions 10*a*, 11*a* of the outer cover 1 and the inner cover 2 separately. In that state, after the steel material 3 is placed on the frame 15, the outer cover 1 and the inner cover 2 are returned to the original positions (the state of FIG. 1). Then heat flame is radiated from a burner (not shown) which is inserted into the hole 4 to a heating chamber formed in a space between the outer cover and the inner cover 2. Thereby the steel material 3 in the inner cover 2 is heated. Then fluorine-and fluoride-containing gas such as $NF_3$ is introduced into the inner cover 2 from the bottom through the pipe 9 to conduct fluorination. In this way, it generally takes about 30 to 60 minutes as mentioned before for the fluorination.

Since the above-mentioned fluorinated steel material 3 is covered with a fluorinated film on the surface, the surface is preferably protected without being oxidized even if it is subjected to outside air such as air. In this state it is stored or immediately nitrided in a second heat treat furnace for nitriding. The second heat treatment furnace for nitriding is of the same structure as of said first heat treatment furnace. That is, the inner cover 2 and the outer cover 1 thereof are lifted up, said fluorinated steel material 3 is charged into the heat treat furnace A', and the inner cover 2 and the outer cover 1 are returned to the original positions respectively. Then flame is blown from the burner into a space between the inner cover 2 and the outer cover 1 to heat the steel material 3 in the inner cover 2 to the nitriding temperatures 400° C. to 700° C. In that state, a sole gas consisting of $NH_3$ or a mixed gas consisting of $NH_3$ and carbon source containing gas is introduced into the heat treat furnace through the pipe 9 from the bottom of the furnace and held for 120 minutes. In this process, said fluorinated layer is reduced or decomposed, for example, as following formulas, by $H_2$ or a small amount of moisture (a by-product of nitriding reaction) to form an activated steel surface.

$$CrF_4 + 2H_2 \rightarrow Cr + 4HF$$

$$2FeF_3 + 3H_2 \rightarrow 2Fe + 6HF$$

At removal of the above-mentioned fluorinated layer, it is possible to decompose the fluorinated layer by blowing a mixed gas of $N_2$ and $H_2$, or $H_2$ gas alone prior to introducing nitrogen gas. It is rather preferred in the light of decreasing troubles by a by-product, ammonium fluoride.

Active nitrogen atoms of nitriding gas origin act against the thus obtained activated steel surface to penetrate and diffuse into the inside of the steel. As a result, an ultra-hard compound layer (a nitrided layer) containing nitrided substance such as CrN, $Fe_2N$, $Fe_3N$, $Fe_4N$ is uniformly and deeply formed and subsequently hard N atom diffused layer is formed to obtain a whole nitrided layer by adding the diffused layer to said compound layer.

Thus, according to the present invention, the steel surface appeared at the same time of decomposition of the fluorinated layer is quite activated and nitrogen atoms acts thereon and penetrates to form ultra-hard nitrided layer uniformly to the deep territory.

Examples are described as follows.

EXAMPLE 1

Figure 1:
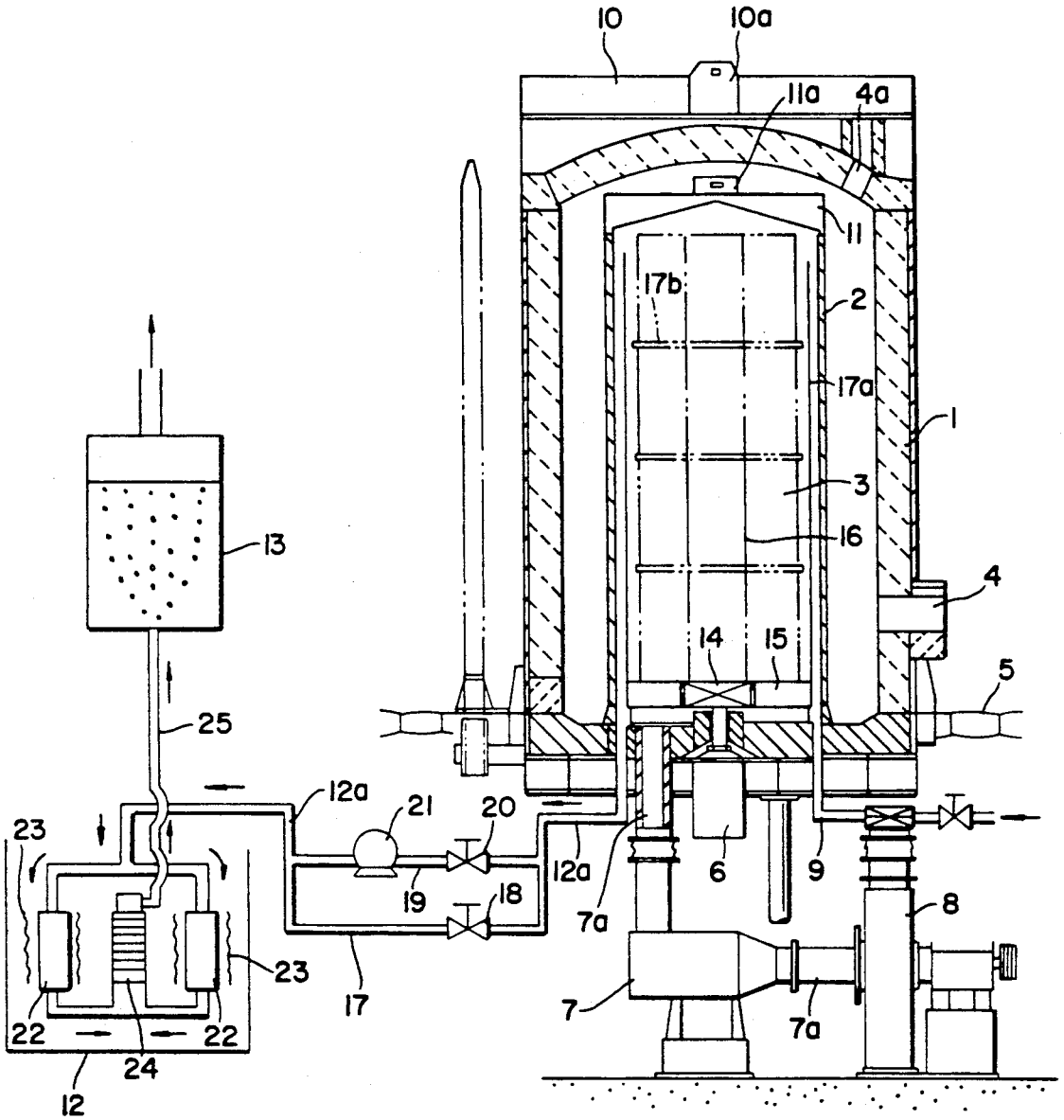
FIG. 1 illustrates, in sectional view, an example of a heat treat furnace used in the present invention.
Figure 2:
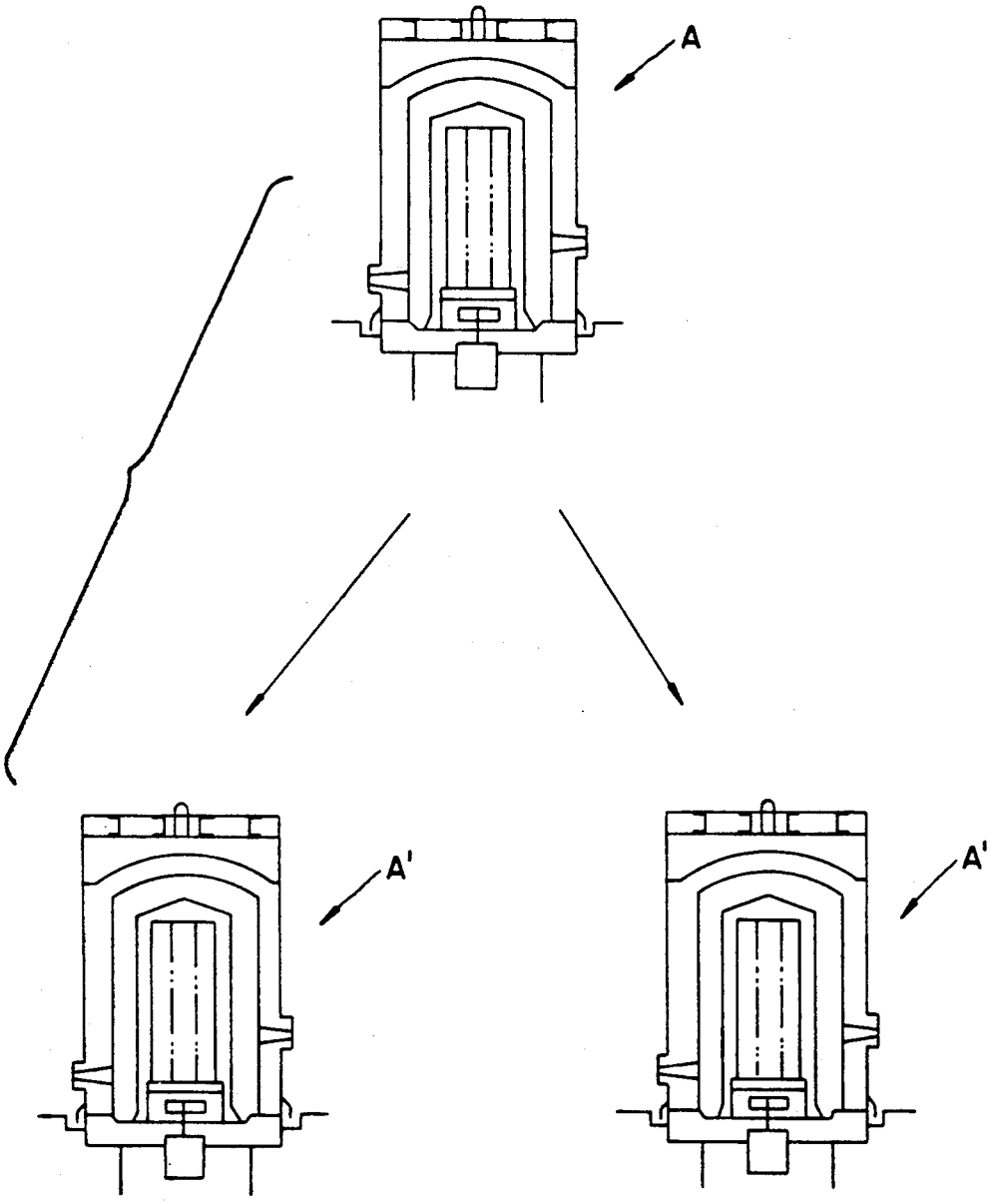
FIG. 2 illustrates, in explanatory views, used condition thereof.

As shown in FIG. 2, for fluorinating and nitriding, two second heat treat furnaces A' were used for nitriding against one first heat treat furnace A for fluorinating.

Fluorinating

After manufacturing a plurality of austinitic SUS screws (samples), they were cleaned with steam using trichloroethylene. Then the cleaned samples were charged into a first heat treat furnace A to heat them at 300° C., and in that state two time amount of volume of the inner cover 2 per unit time of fluoride-containing gas having 1% of $NF_3$ and 99% of $N_2$ was introduced into the inner cover and held for 10 minutes. Then a part of said samples was taken out and checked. As a result, it was confirmed that a fluorinated layer was formed on the whole surface.

Nitriding

Said fluorinated samples were transferred into one of the two second heat treat furnaces A' and a mixed gas containing 25% of $NH_3$, 10% of $CO_2$, 40% of $H_2$ and 25% of $N_2$ was introduced into said second heat treat furnace A' and nitriding was conducted at 400° C. to 600° C. for six hours. Then the samples were air-cooled and taken out. A nitrided layer was formed on the surface of thus obtained samples uniformly.

Next, during the above-mentioned nitriding, after a plurality of samples were fluorinated as well as the above-mentioned in the first heat treat furnace A, the fluorinated samples were charged into another heat treat furnace A' of two second heat treat furnaces A' to nitride as well. Thus two nitriding furnaces A' were combined with a fluorinating furnace A and operate continuously to cut waiting time of the first heat treat furnace A and to be able to conduct effective nitriding.

EXAMPLE 2

Fluorinating and nitriding were carried out by combining two second heat treat furnaces A' with a first heat treat furnace A.

Fluorinating

Pressure in the furnace A is evacuated to 100 torr and using a mixed gas containing 0.1% of $NF_3$ and 99.9% of $N_2$ as fluorinating gas, fluorinating was conducted by holding samples at 350° C. for 30 minutes. Except these, the treatment was carried out as well as in the Example 1.

Nitriding

The nitriding temperature was changed to 570° C. and a gas containing 25% of $NH_3$, 5% of CO, 10% of $H_2$ and 60% of $N_2$ was used for nitriding. The treatment time was changed to 5 hours. Except these, the treatment was carried out as well as in Example 1.

In this example, the same effect as in the Example 1 can be obtained.

EXAMPLE 3

Fluorinating and nitriding were carried out by combining three second heat treat furnaces A' with a first heat treat furnace A.

Fluorinating

Pressure in the furnace A was evacuated to 10 torr and using a mixed gas containing 2% of $NF_3$ and 98% of $N_2$ as fluorinating gas, fluorinating was conducted by holding samples at 330° C. for 40 minutes. Except these, the treatment was carried out as well as in the Example 1.

Nitriding

Nitriding was conducted at 570° C. for 7 hours by using a mixed gas containing 25% of $NH_3$, 10% of $CO_2$, 25% of $H_2$ and 40% of $N_2$ as a fluorinating gas, and holding the samples for 40 minutes at 330° C. Except these, the treatment was carried out as well as in the Example 1.

In this example, the same effect as in the Example 1 can be obtained.

EXAMPLE 4

Temperature of the first heat furnace A in the fluorinating of the Example 1 was changed to 200° C. and a mixed gas of 1% of $F_2$ and 99% of $N_2$ was used as the fluorine- or fluoride containing gas. The introduced amount of the fluorine- or fluoride containing gas and holding time were changed to three time amount of volume of the inner cover 2 per unit time and 20 minutes. Except these conditions, the fluorinating and nitriding was carried out as well as in the Example 1. Nitrided layer of thus obtained samples was quite preferable as the Example 1 wherein $NF_3$ was used in the fluorinating.

In these examples, an outer cover and an inner cover are disposed with each first heat treat furnace for fluorinating and second heat treat furnace for nitriding. But it is possible to use a pit type furnace for one of these furnaces.

However, in such a furnace, there are some disadvantages in that it takes more labour in charging and discharging works and that it is troublesome to replace and repair the furnace material when it is worn out by fluorinating and nitriding.

EFFECT OF THE INVENTION

As mentioned above, in the method for nitriding according to the invention, by holding the steel works in a heated state in an atmosphere of fluorine- or fluoride-containing gas, organic or inorganic foreign matters are removed, and at the same time a passive coat layer such as an oxide layer on the steel surface is changed into a fluorinated layer, and then the steel works are nitrided. In this way, the passive coat layer such as an oxide layer on the steel surface is changed to a fluorinated layer to protect the steel surface in a good condition. Therefore, even if some time passes after formation of the fluorinated layer till nitriding, the fluorinated layer formed on the steel surface protects the steel surface in a good condition. As a result, an oxide layer is never formed on the steel surface again. Such a fluorinated layer is decomposed and removed at subsequent nitriding and thereby the bare steel surface appears. The bare metal surface is activated, so that N atoms easily penetrate into the steel when nitriding. Thereby N atoms penetrate inside the steel from the steel surface deeply and uniformly to form a preferable nitrided layer. In particular, in the method of nitriding according to the present invention, fluorinating and nitriding are not conducted in a same furnace, but separate furnaces for each treatment are prepared. A plurality of furnaces for nitriding which needs considerably long time are disposed against one furnace for fluorinating which is possibly conducted in a comparatively short time, so that there is no gap in time by not using the fluorinating furnace. Thereby continuity and high efficiency of nitriding can be realized.

In the heat treat furnaces according to the invention, since the inner cover and the outer cover thereof are capably lifted up, it is possible to repair the inside thereof easily and quickly, and the repair does not require much time by lifting up the cover even when the inside, fan and the like of the inner cover are worn out due to fluorine- or fluoride-containing gas, nitriding gas and the like.

We claim:

1. A heat treat furnace for fluorinating steel material comprising a lifting type inner cover adapted to contain the steel material therein removably, a lifting type bell formed outer cover which covers the inner cover and forms a defined space from the inner cover, the inside of the inner cover forming a fluorinating chamber, a feeding pipe for fluorine- or fluoride-containing gas, a source of fluorine- or fluoride containing gas communicating with the feeding pipe, an exhaust pipe communicating with said fluorinating chamber, a noxious substance eliminator communicating with said exhaust pipe, said eliminator including means for converting fluorine containing gases to CF4 and removing HF, the defined space between the inner cover and the outer cover forming a heating chamber, and a means for heating the fluorinating chamber disposed in said heating chamber.

2. A furnace apparatus including a heat treat furnace for fluorinating steel material comprising a lifting type inner cover adapted to contain the steel material therein removably, a lifting type bell formed outer cover which covers the inner cover and forms a defined space from the inner cover, the inside of the inner cover forming a fluorinating chamber, a feeding pipe for fluorine- or fluoride-containing gas, a source of fluorine- or fluoride containing gas communicating with the feeding pipe, an exhaust pipe communicating with said fluorinating chamber, a noxious substance eliminator communicating with said exhaust pipe, the defined space between the inner cover and the outer cover forming a heating chamber, and a means for heating the fluorinating chamber disposed in said heating chamber, and at least one heat treat furnace for nitriding fluorinated steel material comprising a second lifting type inner cover adapted to contain the fluorinated steel material therein removably, a second lifting type bell formed outer cover which covers the second inner cover and forms a second defined space from the inner cover, the inside of the second inner cover forming a nitriding chamber, a feeding pipe for feeding nitriding gas and an exhaust pipe disposed in said nitriding chamber, the second defined space between the second inner cover and the second outer cover forming a second heating chamber, and a means for heating the nitriding chamber disposed in said second heating chamber.

* * * * *